United States Patent [19]

Frykhult et al.

[11] Patent Number: 4,510,056

[45] Date of Patent: Apr. 9, 1985

[54] HYDROCYCLONE SEPARATOR

[75] Inventors: Rune H. Frykhult, Huddinge; Lars-Goran Rundquist, Tumba, both of Sweden

[73] Assignee: AB Celleco, Stockholm, Sweden

[21] Appl. No.: 445,437

[22] Filed: Nov. 30, 1982

[30] Foreign Application Priority Data

Dec. 4, 1981 [SE] Sweden ..... 8107262

[51] Int. Cl.[3] ..... B04C 5/103; B04C 5/14

[52] U.S. Cl. ..... 210/512.1; 55/191; 55/399; 55/459 R; 209/144; 209/211; 210/788

[58] Field of Search ..... 210/512.1, 512.2, 304, 210/788, 512.3; 55/399, 191, 459 R; 209/144, 211

[56] References Cited

U.S. PATENT DOCUMENTS

| | | | |
|---|---|---|---|
| 3,399,770 | 9/1968 | Salomon | 210/512.1 |
| 3,800,946 | 4/1974 | Reid et al. | 55/191 |
| 4,153,558 | 5/1979 | Frykhult | 210/512.1 |
| 4,224,145 | 9/1980 | Skardal | 210/512 R |
| 4,309,283 | 1/1982 | Vikio et al. | 210/512.1 |

FOREIGN PATENT DOCUMENTS 187435 1/1964 Sweden .

*Primary Examiner*—Ernest G. Therkorn
*Attorney, Agent, or Firm*—Cyrus S. Hapgood

[57] ABSTRACT

In a hydrocyclone separator for separating a mixture into one light and one heavy fraction, with a separation chamber consisting partly of one circular cylindrical part and partly of one conical part, the wall of the separation chamber (1, 2) is provided, along a substantial part of its axial elongation, with a means creating a turbulence to a relatively moderate degree and which extends in a screw path (7) opposite to the screw path in which the flow streams along the wall of the separation chamber. Advantageously, at least one guide bar (6) with substantially axial elongation is provided to give the flow, streaming in a screw path along the wall of the separation chamber (1, 2) a radially inwardly directed component. The screw-path-formed limiting surface (7) of said means may form the angle $\alpha = 0°-75°$ to the axial symmetry axis (9) of the separation chamber (1, 2).

8 Claims, 5 Drawing Figures

4
II
II
1
9
8
7
α
2
6
III
III
6
6
5

4
1
3

6
6
6
6

β
2'
7'
8'
9'

γ
2''
9''
7''
8''

HYDROCYCLONE SEPARATOR

This invention relates to a hydrocyclone separator for separating a mixture into a light first fraction of relatively low density and a heavy second fraction of relatively high density, the separator comprising a separation chamber consisting of a circular cylindrical part provided with a tangential inlet for the feed mixture and a central outlet for the light fraction, as well as a conical part forming an outlet for the heavy fraction.

Hydrocyclone separators have many uses. A major one is in the cellulose industry for the purification of cellulose fiber suspensions. Generally, a hydrocyclone separator system includes several stages coupled in series with every stage comprising several hydrocyclone separators connected in parallel, having inlet and outlet chambers in common. Such a hydrocyclone separator system separates the original, highly diluted cellulose suspension into diluted, purified fibers, called the "light fraction", and thickened impurities, called the "heavy fraction".

Increased production capacities and increased energy costs have given rise to a demand for a way to carry out said separation (purification) with a higher concentration of fiber in the feed than that which has been used hitherto. With changed manufacturing processes, the operation temperatures have risen. Furthermore, environmental regulations have been tightened up so that the fiber loss with the heavy fraction (the so-called reject discharge) must be reduced, which means increased difficulties when designing hydrocyclone plants.

Several attempts to solve said problems, especially regarding fiber loss and plugging of the discharge outlet of relatively heavy fraction, have been published hitherto, for example, in the Swedish Patent Specification No. 7702500, which relates to a hydrocyclone separator of the type mentioned by way of introduction. This is provided in the vicinity of the discharge outlet with a guide means which gives the heavy fraction, flowing towards the discharge outlet of the conical part, a component of movement directed axially inwards towards the separation chamber. Furthermore, there is provided in the conical part of the separation chamber at least one guide bar substantially extended axially and designed to give the stream of heavy fraction, flowing in a screw path along the wall of the conical part, a component directed radially inwards. Such a design permits a better operational safety, reduced operational costs and lower loss of fiber, compared to previously known hydrocyclone separators.

The principal object of the present invention is to provide a hydrocyclone separator of the type originally mentioned which has a high operational reliability, low operational costs, low fiber losses and which permits cellulose fiber suspensions with a higher fiber concentration, than those hitherto used, to be separated (purified).

According to the invention, a hydrocyclone separator of the kind mentioned above is characterized in that the wall of the separation chamber is provided, along a substantial part of its axial elongation, with a means which creates turbulence to a relatively moderate degree and which runs in a screw path opposite to the screw path in which the flow streams along the wall of the separation chamber. The turbulence-creating means provides such flow conditions in the hydrocyclone separator that any deposits on the wall of the separation chamber are counteracted in spite of relatively high fiber concentration in the incoming cellulose fiber suspension. Said means can be arranged both in the circular cylindrical part and the conical part of the separation chamber, or just in one of them, according to the field of use.

In one embodiment, at least one guide bar with substantially axial elongation is arranged to give the flow, streaming in a screw path along the wall of the separation chamber, a component directed radially inwards. This guide bar, or these guide bars, are usually arranged in the lower region of the conical part of the separation chamber, but a location in its upper region or even in the circular cylindrical part is possible. When arranged in the conical part, they will facilitate an efficient separation of downstreaming flow of heavy fraction and rising flow of light fraction.

In one preferred embodiment, the screw-path-formed limiting surface of the turbulence-creating means forms an angle $\alpha$ to a plane perpendicular to the axial symmetry axis of the separation chamber, $\alpha$ being in the range 0°-75°.

It is especially suitable when $\alpha$ is within the range 40°-65°. The width of the screw-path-formed limiting surface of the turbulence creating means must be of such an extent as to permit a relatively moderate turbulence, but not to such an extent that too violent turbulence is created in the separation chamber. This means that the part of the inner wall of the separation chamber that does not constitute the screw-path-formed limiting surface of the turbulence creating means, and that forms the previously mentioned opposite screw path, is provided by a generatrice of which the inclination to the axial symmetry axis of the separation chamber varies with the cone angle. If the cone angle is great, that is, the conical part of the separation chamber has a relatively small axial elongation, said generatrice must be inclined with an acute angle $\beta$ to the axial symmetry axis of the separation chamber as seen from the discharge outlet for the heavy fraction from the hydrocyclone separator, in order that the screw-path-formed limited surface of the turbulence creating means shall not be too wide. If on the other hand the conical part is relatively elongated, said generatrice must be inclined with an acute angle $\gamma$ to the axial symmetry axis of the separation chamber, as seen from the inlet of the hydrocyclone separator. The situation is analogue in the circular cylindrical part of the separation chamber, where said generatrice must be inclined with an angle $\gamma$ to the axial symmetry axis in order that there shall be place for a turbulence creating means in the form of a screw path.

In one special case, regarding the conical part of the separation chamber, said generatrice is parallel to the axial symmetry axis of the separation chamber.

DETAILED DESCRIPTION OF THE DRAWINGS

Figures 1, 2, 3, 4, 5:
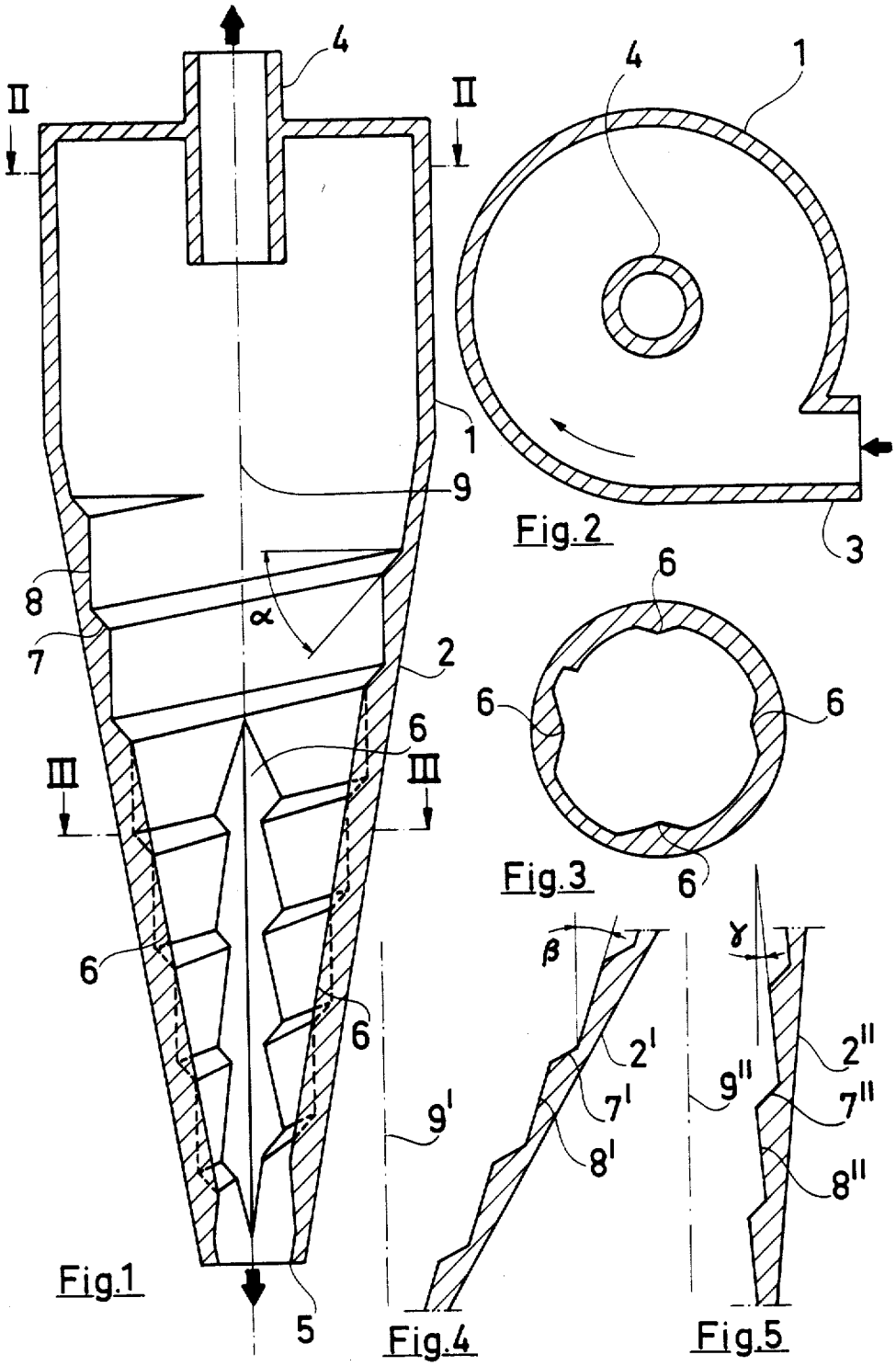
FIG. 1 is a longitudinal sectional view of a hydrocyclone separator according to the invention, with a turbulence creating means shown schematically.
FIG. 2 is a transverse sectional view on line II—II in FIG. 1.
FIG. 3 is a transverse sectional view on line III—III in FIG. 1.
FIG. 4 is a longitudinal sectional view of part of the wall of a conical separation chamber.
FIG. 5 is similar to FIG. 4 but with another conicity.

In FIGS. 1-3 the hydrocyclone separator has a circular cylindrical part 1, a conical part 2, a tangential inlet 3 for the mixture to be separated, a central outlet 4 for the specifically lighter fraction, and an outlet 5 from the conical part for the specifically heavier fraction. In the conical part 2 are four axial guide bars 6 evenly distributed around the periphery of the conical part. These guide bars, as seen in a transverse sectional view (FIG. 3), have the form of symmetric ridges. A turbulence creating means is arranged in the form of screw path 7 extending along the conical part 2 of the separation chamber. The generatrice of the screw path 7 forms the angle $\alpha$ with the axial symmetry axis 9 of the separation chamber. The angle $\alpha$ is 45° in the example shown. The region of the inner wall of the conical part 2 that does not constitute the screw-path-formed limiting surface of the turbulence creating means forms a screw path 8, the generatrice of which in the example shown is parallel to the axial symmetry axis 9 of the separation chamber. In FIG. 4 there is shown in part a wall in a conical separation chamber with relatively small elongation. The references $2^1$, $7^1$ and $8^1$ correspond to the references 2, 7 and 8 in FIG. 1, and $9^1$ is the axial symmetry axis of the conical separation chamber. The screw path $8^1$ is inclined outward with the angle $\beta$ as seen from the discharge outlet of the hydrocyclone separator.

In FIG. 5 there is shown in part a wall in a conical separation chamber with relatively great elongation. In this case references 2'', 7'' and 8'' correspond to references 2, 7 and 8 in FIG. 1, and 9'' corresponds to $9^1$ in FIG. 4. The screw path 8'', as seen from the inlet of the hydrocyclone separator, is inclined outwards with the angle $\gamma$.

As shown in FIG. 2, tangential inlet 3 is positioned to direct the incoming stream clockwise around axis 9 of the separation chamber (as seen from above). Thus, as the stream descends along the chamber wall, it rotates clockwise in the afore-mentioned screw path 8, as indicated by the broken lines in FIG. 1, this first screw path leading to bottom outlet 5. The other screw path 7, as previously mentioned, runs opposite to screw path 8 and therefore tends to rotate the feed stream counterclockwise around axis 9 as it descends along the chamber wall. Thus, this second screw path 7, by imposing a resistance to the clockwise rotation, acts to create turbulence in the feed stream as it spirals downward toward outlet 5.

Within the scope of the invention, a series of embodiments are possible. As an example, the turbulence creating means can extend more or less far axially within the circular cylindrical and conical parts of the separation chamber. The guide bar or guide bars with substantially axial elongation can be arranged in different ways in the separation chamber in relationship to said means.

As an example of the function of a hydrocyclone separator according to the invention, the same purification result is obtained with a feed fiber concentration of 0.9% (weight) cellulose previously obtained with a feed fiber concentration of 0.6% (weight). This increase has great economic importance, which is obvious from the following operational example. If the production capacity in a cellulose plant is 1000 tons/24 h, the fiber mass flow that has to be purified is 115 $m^3$/min. at a fiber concentration of 0.9% (weight). This means lower costs both for investment and operation, among other things 30% lower costs for energy.

In the foregoing only purification of fiber mass suspensions has been dealt with. However, the hydrocyclone separator according to the invention can also be used in other fields outside the pulp and paper industry.

We claim:

1. A hydrocyclone separator for separating a mixture into a light fraction of relatively low density and a heavy fraction of relatively high density, the separator comprising a housing forming a separation chamber having a circular cylindrical part located at an enlarged end portion of the housing and a conical part tapering from the cylindrical part, said cylindrical and conical parts having a substantially common axis, said cylindrical part having a tangential inlet for the feed mixture and also having an axial outlet for said light fraction, said conical part having a heavy fraction outlet located at a reduced end portion of the housing, said chamber having a wall along which a stream of said mixture is adapted to flow from said inlet toward said heavy fraction outlet, said tangential inlet being positioned to direct said stream in a first screw path along said wall while rotating in one direction about said axis, said wall having outside said heavy fraction outlet, and along a substantial part of said walls axial extent, means forming a second screw path opposite to said first screw path and thereby create turbulence in said stream as it flows along said first screw path.

2. The separator of claim 1, comprising also a guide bar located on said wall of the separation chamber and being substantially elongated axially of said chamber, the guide bar being positioned to give said flow in said first screw path a radially inwardly directed component.

3. The separator of claim 1, in which said turbulence creating means has a limiting surface partly defining said second screw path, said limiting surface forming an angle $\alpha$ with a plane perpendicular to the axial symmetry axis of the separation chamber, said angle $\alpha$ being in the range of 0°-75°.

4. The separator of claim 3, in which said angle is in the range of 40°-65°.

5. The separator of claim 1, in which said turbulence creating means is provided in said conical part of the separation chamber.

6. The separator of claim 5, in which said first screw path occupies part of said chamber wall which is not occupied by a limiting surface of said second screw path, said first screw path having a generatrice which slopes outward toward said enlarged end portion from said common axis and forms an acute angle therewith.

7. The separator of claim 5, in which said first screw path occupies part of said chamber wall which is not occupied by a limiting surface of said second screw path, said first screw path having a generatrice which is parallel to said common axis.

8. The separator of claim 5, in which said first screw path occupies part of said chamber wall which is not occupied by a limiting surface of said second screw path, said first screw path having a generatrice which slopes inward toward said common axis in the direction toward said enlarged end portion and forms an acute angle with said axis.

* * * * *

UNITED STATES PATENT AND TRADEMARK OFFICE

CERTIFICATE OF CORRECTION

PATENT NO. : 4,510,056

DATED : April 9, 1985

INVENTOR(S) : Rune H. Frykhult

It is certified that error appears in the above—identified patent and that said Letters Patent is hereby corrected as shown below:

Col. 3, line 20, after "forms" cancel "a" and insert--the previously mentioned opposite--.

Col. 3, line 61, after "cellulose" insert--as was--.

Signed and Sealed this

*Fourth* Day of *March 1986*

[SEAL]

*Attest:*

DONALD J. QUIGG

*Attesting Officer*

*Commissioner of Patents and Trademarks*